US005577469A

United States Patent [19]

Muller et al.

[11] Patent Number: 5,577,469

[45] Date of Patent: Nov. 26, 1996

[54] DEVICE FOR CONTROLLING A VALVE OF AN INTERNAL COMBUSTION ENGINE

[75] Inventors: Leopold Müller, Chemnitz; Frank Schwabe, Rodewisch, both of Germany

[73] Assignee: IAV Motor GmbH, Chemnitz, Germany

[21] Appl. No.: 405,142

[22] Filed: Mar. 16, 1995

[30] Foreign Application Priority Data

Mar. 16, 1994 [DE] Germany ..... 44 08 808.6

[51] Int. Cl.[6] ..... F01L 1/18; F01L 1/20; F01L 1/04; F01L 13/00

[52] U.S. Cl. ..... 123/90.16; 123/90.44

[58] Field of Search ..... 123/90.15, 90.16, 123/90.17, 90.27, 90.36, 90.39, 90.4, 90.44, 90.45, 90.46, 90.47

[56] References Cited

U.S. PATENT DOCUMENTS

| | | | |
|---|---|---|---|
| 4,777,914 | 10/1988 | Konno | 123/90.16 |
| 5,090,364 | 2/1992 | McCarroll et al. | 123/90.16 |
| 5,239,952 | 8/1993 | Morita | 123/90.16 |
| 5,301,636 | 4/1994 | Nakamura | 123/90.16 |
| 5,402,756 | 4/1995 | Bohme et al. | 123/90.16 |
| 5,413,071 | 5/1995 | Paul et al. | 123/90.16 |

FOREIGN PATENT DOCUMENTS 3800347 8/1992 Germany .

*Primary Examiner*—Weilun Lo
*Attorney, Agent, or Firm*—Collard & Roe, P.C.

[57] ABSTRACT

A device connected to a valve stem for controlling a valve of an internal combustion engine. The device includes a cam having a first peripheral contour and a disk having a second peripheral contour smaller than the first peripheral contour. A first rocker arm is pivotable on an axle mounted bearing based on the second peripheral contour of the disk. A compensation device is positioned between the first rocker arm and the valve stem for maintaining contact therebetween. A second rocker arm is pivotable on the bearing based on the first peripheral contour of the cam. A drive selectively couples the second rocker arm to the valve stem. The drive includes a radially displaceable spherical driver disposed within the first rocker arm. A locking slide includes an engagement surface which radially displaces the spherical drive into a spherical depression on the second rocker arm so that the valve operates based on the first peripheral contour of the cam.

8 Claims, 4 Drawing Sheets

DEVICE FOR CONTROLLING A VALVE OF AN INTERNAL COMBUSTION ENGINE

BACKGROUND OF THE INVENTION

1. Field of the Invention

The present invention relates to a device for controlling a valve of an internal combustion engine. More particularly, it relates to a device for selectively coupling two different rocker arms to the valve.

2. The Prior Art

Valve drives are known, for example, from German patent DE-PS 3,800,047. A first transmission lever is supported on a shaft in the cylinder head and is in engagement with the first cam for slightly opening the valve. The lever is supported on the valve via a compensation device which maintains contact therebetween. A second U-shaped transmission lever is in engagement with the cam halves of the second cam for maximum opening. A drive device selectively couples the second lever to the first transmission lever, i.e., to effect valve lift. The drive device is designed as a switchable, radial pin for coupling adjacent radial contours of the two transmission levers.

The drawback with such a design is that the drive device has a driver which produces a form lock when engaging a bore. The angular position and the axial position of the transmission levers have to be exactly right, i.e., when the large effective stroke is switched on, the drive device requires a centering function in both the axial and radial directions irrespective of oil pressure variations and has to be forcefully maintained in the form lock.

SUMMARY OF THE INVENTION

It is an object of the present invention to overcome the drawbacks of the prior art and to provide a valve controller which can easily switch between its two terminal positions.

It is a further object of the present invention to provide a valve controller which remains in the intended terminal position.

These and other related objects are achieved according to the invention by a locking slide, which is alternately hydraulically displaceable for moving and locking the drivers. This system provides self-locking and insensitivity to pressure variations in the locking slide control pressure. The spherical engagement contour on the driver and the engagement contour on one of the tappets, provides axial and radial self-centering between the rocker arms.

The drive mechanism for the locking slide is positioned within the upper portion of the rocker arm or next to the compensation device.

The device according to the invention is connected to a valve stem for controlling a valve of an internal combustion engine. The device includes a cam having a first peripheral contour and a disk having a second peripheral contour smaller than the first peripheral contour. A first rocker arm is pivotable on an axle mounted bearing based on the second peripheral contour of the disk. A compensation device is positioned between the first rocker arm and the valve stem for taking up slack and play for maintaining contact therebetween. A second rocker arm is pivotable on the bearing based on the first peripheral contour of the cam. The second rocker arm includes a spherical depression. Drive means selectively couples the second rocker arm to the valve stem. The drive means consists of a radially displaceable, spherical driver disposed within the first rocker arm. A locking slide is hydraulically movable within the first rocker arm parallel to the axle between an unlocked position and a locked position. The locking slide moves when the cam and the disk pass through their base circles. The locking slide includes an engagement surface which radially displaces the spherical driver into the spherical depression upon movement into the locked position so that the valve operates based on the first peripheral contour of the cam.

The compensation device includes an oil supply space. The drive means consists of two oil ducts for hydraulically moving the locking slide between the two positions, where the oil ducts will alternately feed oil to the oil supply space. The compensation device includes two overflow bores in communication with the oil supply space for feeding oil to the oil supply space. The drive means includes a bore with two ends for accommodating the locking slide. The bore is positioned adjacent the oil supply space. The first rocker arm includes two cam followers positioned on either side of the second rocker arm. The two ends of the bore are in communication with each other. An adjustable stop is provided, wherein the compensation device biases the first rocker arm against the adjustable stop when the cam passes through its base circle. Alternatively, a spring-loaded pressure sleeve biases the second rocker arm onto the cam.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
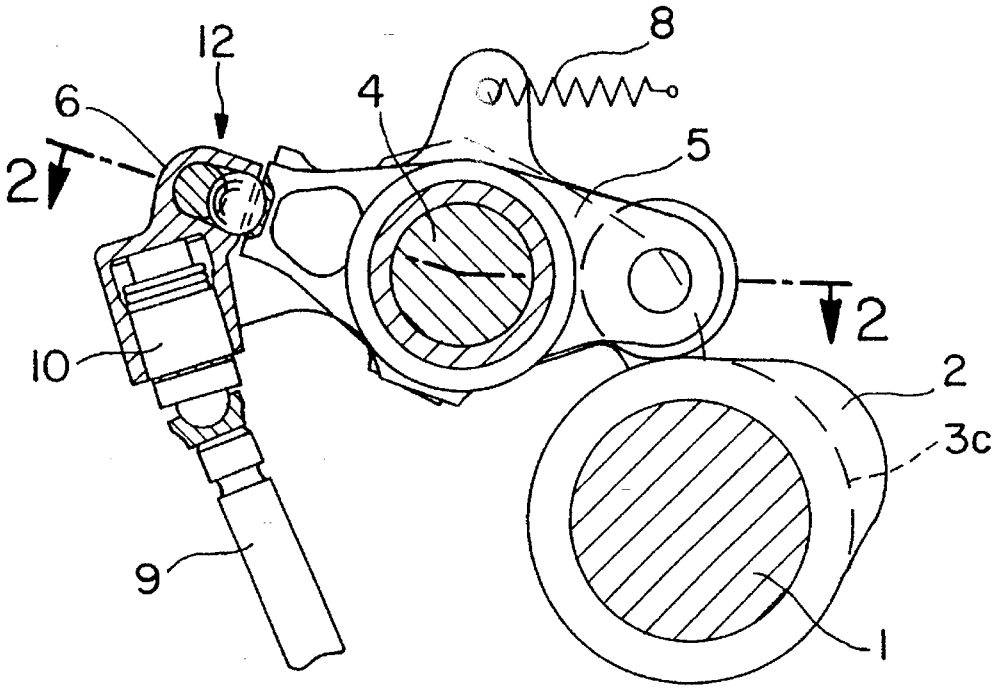
FIG. 1 is a side elevational view, in part cross-section, of a valve drive according to the invention.
Figure 2:
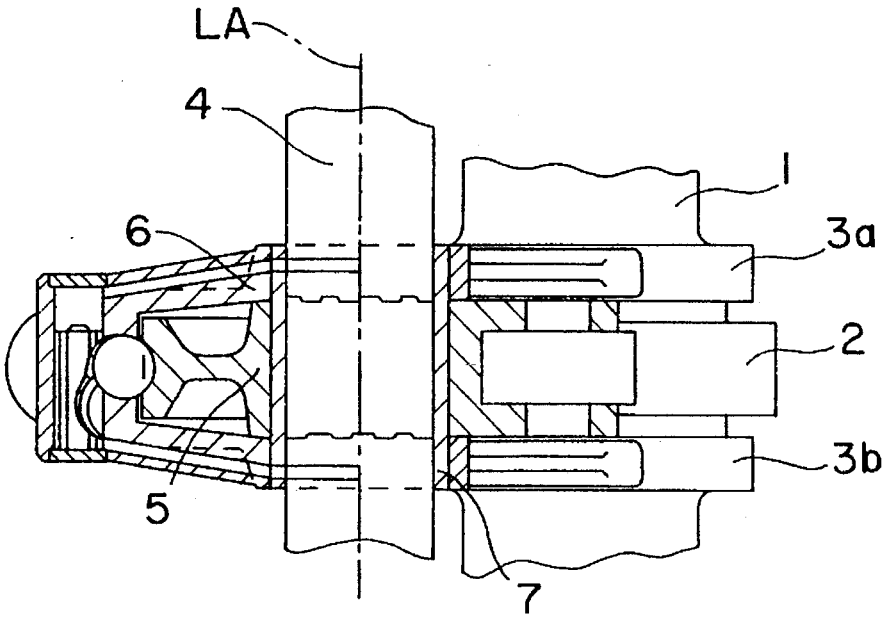
FIG. 2 is a cross sectional view of the valve drive taken along the line 2—2 from FIG. 1.

Turning now in detail to the drawings and, in particular FIGS. 1 and 2, there is shown a camshaft 1 supported in the cylinder head with a cam 2 and smaller cams, disks or cylinders 3*a* and 3*b*, which are associated with a valve or pair of valves. Cam 2, which provides maximum lift, is arranged in the center, with symmetric disk halves 3*a*, 3*b* of the smaller disk arranged on both sides of cam 2.

FIG. 2 shows a rocker arm 5 which is constantly in engagement with cam 2 due to the force of spring 8. A U-shaped rocker arm 6 engages disk halves 3*a*, 3*b*. Rocker arms 5 and 6 are pivotable independently of each other, but are both supported on a bearing or bushing on an axle 4 in the cylinder head. In such a configuration, the forces of distortion on drive mechanism 12 only act as a static force between rocker arms 5, 6 and bearing 7.

Transmission lever 5 is connected to a tension spring 8 which is counter-supported on the cylinder head. Alternatively, a compression spring 81 (FIG. 7) presses against rocker arm 5 via a sleeve 82. The force of spring 81 results in permanent contact of rocker arm 5 with the associated cam 2.

Rocker arm 6 is supported on a valve stem 9 via a compensation device 10 which compensates for play between rocker arm 6 and valve stem 9. Compensation device 10 is supported within rocker arm 6. FIG. 2 shows that rocker arms 5 and 6 can be locked together by means of a drive mechanism 12.

Figure 3:
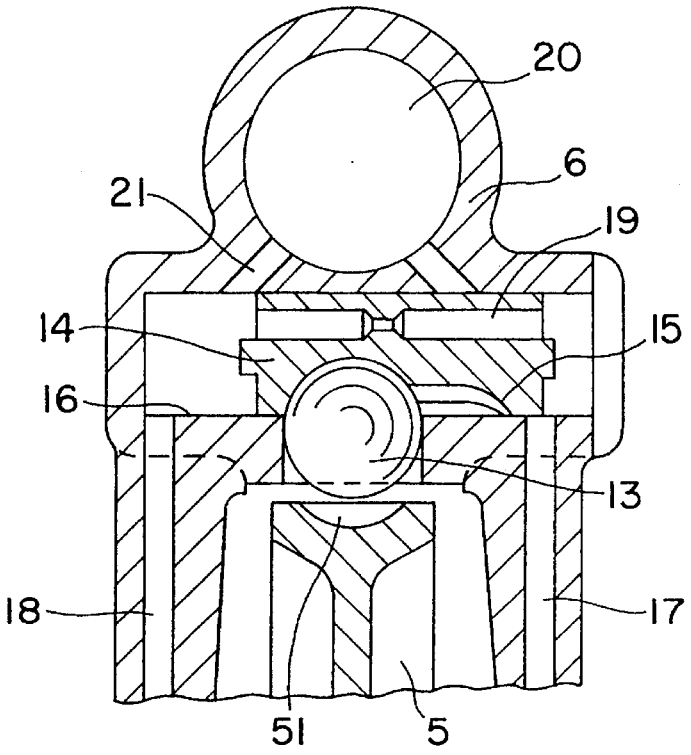
FIG. 3 is a top plan view, in cross section, of a rocker arm with a drive mechanism disengaged.
Figure 4:
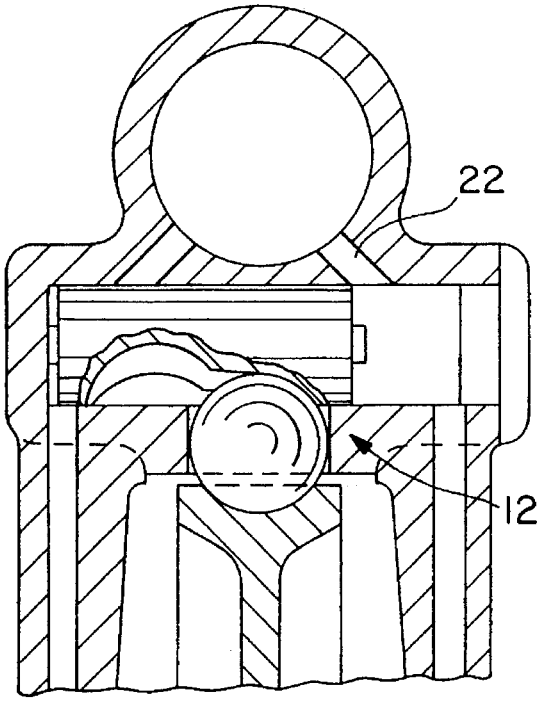
FIG. 4 is a top plan view, in cross section, of the rocker arm with the drive mechanism engaged.

FIGS. 3 and 4 show the structure of drive mechanism 12. A ball 13 forms a driver which is selectively displaced by a locking element 14 which is slidable in a direction parallel to axle 4. Engagement between rocker arms 5 and 6 is possible only when the arms jointly pass through the range of parallel base circle sectors of cam 2 and cam halves 3*a*, 3*b*, i.e., the lowest common points of cam 2, and disks 3*a* and 3*b*. Each locking element 14 has an engagement surface 15, which displaces ball 13 during hydraulic displacement of locking element 14 into the locked position. Ball 13 engages spherical depression 51 in rocker arm 5, and is maintained in that position.

Locking element 14 is sealed within a guide bore 16 in rocker arm 6, and is alternately acted upon by hydraulic pressure via the ducts 17, 18. Locking element 14 is displaceable between the unlocked position shown in FIG. 3 and the locked position shown in FIG. 4. Overflow bores 21 or 22 alternately feed oil to a supply space 20 of compensation element 10. A cross flow bore 19 connects opposite ends of guide bore 16 to insure proper lubrication of the moving parts. Alternatively, the cross flow bore is positioned within rocker arm 6 to connect opposite ends of bore 16.

It is possible with such an arrangement to completely switch-off the valve or switch between two different cams 2 and 3*a*, 3*b*. For switching off the valve, cams 3*a*, 3*b*, shown in FIG. 2, each are replaced by a circular or cylindrical disk 3*c* (see FIG. 1), which keeps the valve basically closed or, for the purpose of self-cleaning, opens said valve slightly to form a very small air gap.

For controlling an exhaust valve, cam halves 3*a*, 3*b* would be contoured for the normal exhaust function of such a valve. Cam 2 would then control the exhaust valve for engine braking by relieving the compression pressure.

Figure 5:
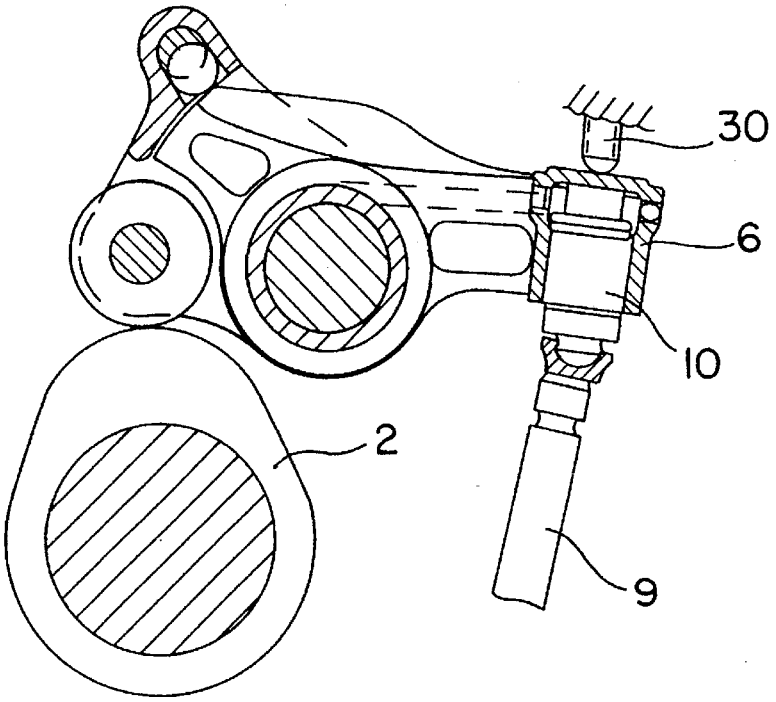
FIG. 5 is a side elevational view, in part cross-section, of the rocker arm with the drive mechanism disengaged.
Figure 6:
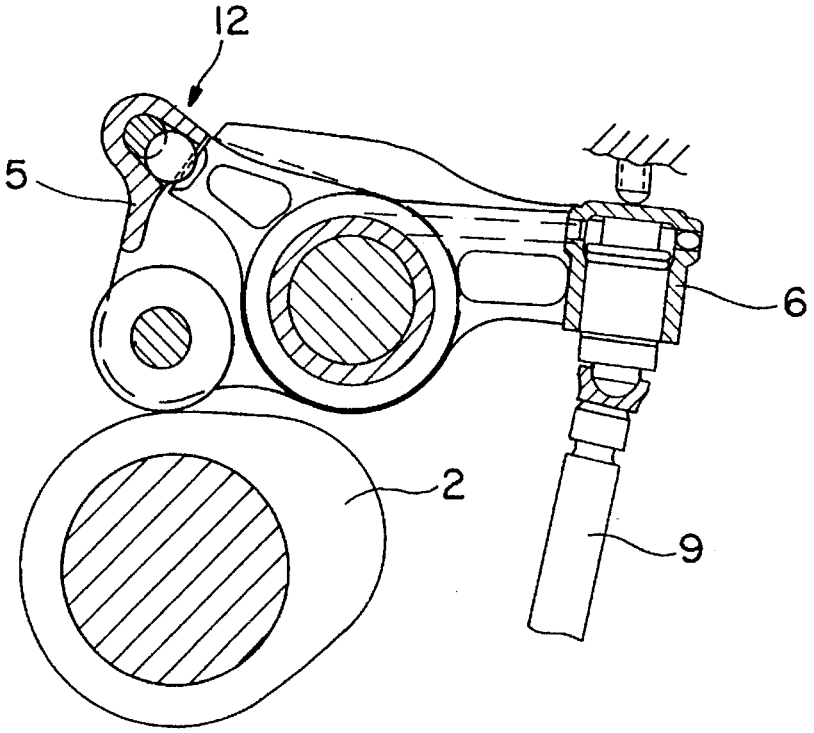
FIG. 6 is a side elevational view, in part cross-section of the rocker arm with the driver device engaged.

FIGS. 5 and 6 show a valve drive according to the invention with a drive mechanism in the inoperative and operative conditions, respectively. The device is arranged above the camshaft. The lift on rocker arm 5 can be seen in FIG. 5. Rocker arm 6 is not carried along and valve 9 is switched off. The spring 8, which keeps rocker arm 5 continuously engaged with cam 2, is not shown. An adjustable stop 30 contacts first rocker arm 5 when the cam passes through its base circle.

Figure 7:
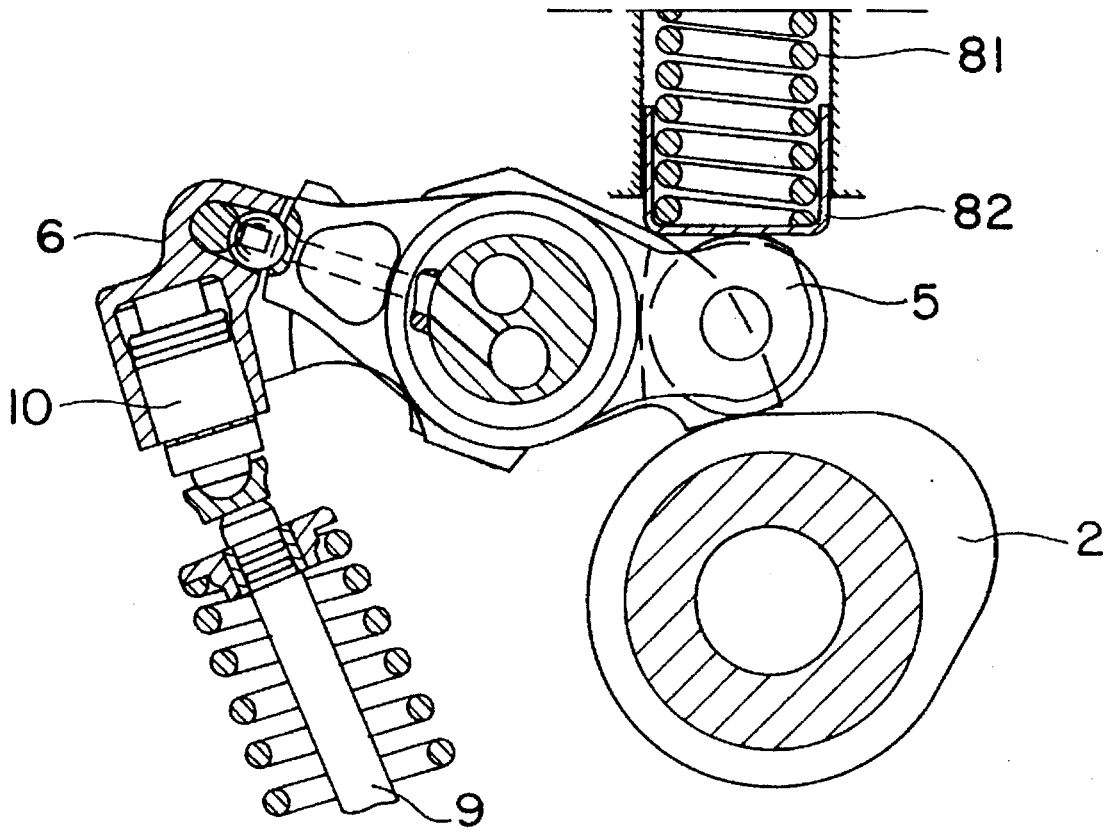
FIG. 7 is a side elevational view, similar to FIG. 1, with an alternate spring arrangement.

FIG. 7 shows an arrangement for the spring 81, in which its force is direct onto cam 2 via the pressure sleeve 82. Spring 8 could also be a coiled or straight elastic spring, or a hairpin spring.

While several embodiments of the present invention have been shown and described, it is to be understood that many changes and modifications may be made thereunto without departing from the spirit and scope of the invention as defined in the appended claims.

What is claimed is:

1. A device connected to a valve stem for controlling a valve of an internal combustion engine, the device comprising:

a cam having a first peripheral contour and a disk having a second peripheral contour smaller than said first peripheral contour;

an axle including a bearing, an axial direction and a radial direction;

a first rocker arm pivotable on said bearing based on said second peripheral contour of said disk;

a compensation device positioned between said first rocker arm and the valve stem for maintaining contact therebetween;

a second rocker arm pivotable on said bearing based on said first peripheral contour of said cam, said second rocker arm including a spherical depression; and drive means for selectively coupling said second rocker arm to the valve stem, said drive means comprising:

a radially-displaceable, spherical driver disposed within said first rocker arm; and a locking slide hydraulically moveable within said first rocker arm parallel to the axial direction between an unlocked position and a locked position, said locking slide moving when said cam and said disk pass through their base circles, said locking slide including an engagement surface which radially displaces said spherical driver into the spherical depression upon movement into said locked position so that the valve operates based on said first peripheral contour of said cam.

2. The device according to claim 2, wherein said compensation device includes an oil supply space; and said drive means comprises two oil ducts for hydraulically moving said locking slide between said locked position and said unlocked position, wherein said oil ducts alternately feed oil to the oil supply space.

3. The device according to claim 2, wherein said compensation device includes two overflow bores in communication with said oil supply space for feeding oil to the oil supply space.

4. The device according to claim 2, wherein said drive means includes a bore with two ends for accommodating said locking slide, the bore is positioned adjacent the oil supply space.

5. The device according to claim 4, wherein said first rocker arm includes two cam followers positioned on either side of said second rocker arm; and the bore is positioned above said cam and said disk.

6. The device according to claim 4, wherein the two ends of the bore are in communication with each other.

7. The device according to claim 1, comprising an adjustable stop, wherein said compensation device biases said first rocker arm against said adjustable stop when said cam passes through its base circle.

8. The device according to claim 1, comprising a spring-loaded pressure sleeve for biasing said second rocker arm onto said cam.

* * * * *